US011842844B2

(12) United States Patent
Urabe et al.

(10) Patent No.: US 11,842,844 B2
(45) Date of Patent: Dec. 12, 2023

(54) COIL COMPONENT

(71) Applicant: TDK CORPORATION, Tokyo (JP)

(72) Inventors: Junichiro Urabe, Tokyo (JP); Hajime Kato, Tokyo (JP); Yuto Shiga, Tokyo (JP); Kazuya Tobita, Tokyo (JP); Youichi Kazuta, Tokyo (JP); Noriaki Hamachi, Tokyo (JP); Toshinori Matsuura, Tokyo (JP); Yuichi Takubo, Tokyo (JP); Asami Takahashi, Tokyo (JP); Munehiro Takaku, Tokyo (JP)

(73) Assignee: TDK CORPORATION, Tokyo (JP)

( * ) Notice: Subject to any disclaimer, the term of this patent is extended or adjusted under 35 U.S.C. 154(b) by 408 days.

(21) Appl. No.: 17/166,448

(22) Filed: Feb. 3, 2021

(65) Prior Publication Data

US 2021/0249184 A1 Aug. 12, 2021

(30) Foreign Application Priority Data

Feb. 7, 2020 (JP) ..... 2020-020020

(51) Int. Cl.
*H01F 27/28* (2006.01)
*H01F 27/29* (2006.01)
*H01F 17/00* (2006.01)

(52) U.S. Cl.
CPC ..... *H01F 27/292* (2013.01); *H01F 17/0013* (2013.01); *H01F 27/2847* (2013.01); *H01F 2017/0073* (2013.01)

(58) Field of Classification Search
CPC ..... H01F 27/292; H01F 17/0013; H01F 27/2847; H01F 2017/0073; H01F 41/043; H01F 5/00; H01F 5/04
USPC ..... 336/192, 200, 232
See application file for complete search history.

(56) References Cited

U.S. PATENT DOCUMENTS

| | | | | |
|---|---|---|---|---|
| 2014/0145815 | A1 | 5/2014 | Ishii et al. | |
| 2014/0224418 | A1 | 8/2014 | Seko | |
| 2015/0187486 | A1* | 7/2015 | Lim | H01F 27/292 29/602.1 |
| 2018/0096778 | A1* | 4/2018 | Yatabe | H01F 27/292 |
| 2018/0197675 | A1* | 7/2018 | Kido | H01F 41/122 |
| 2019/0115134 | A1 | 4/2019 | Park et al. | |
| 2019/0355508 | A1* | 11/2019 | Lim | H01F 17/0013 |

FOREIGN PATENT DOCUMENTS

| | | |
|---|---|---|
| JP | 2014-107513 A | 6/2014 |
| JP | 2014-154716 A | 8/2014 |
| JP | 2019-075535 A | 5/2019 |

* cited by examiner

*Primary Examiner* — Shawki S Ismail
*Assistant Examiner* — Kazi S Hossain
(74) *Attorney, Agent, or Firm* — Oliff PLC

(57) ABSTRACT

In a coil 5 of a multilayer coil component 1, an end portion 6*a* of a turn 6 closest to a side surface 2*e* in the facing direction of the side surface 2*e* and a side surface 2*f* is connected to a first external electrode 3 and an end portion 11*a* of a turn 11 closest to the side surface 2*f* in the facing direction of the pair of side surfaces 2*e* and 2*f* is connected to a second external electrode 4. The area at which the turn 6 faces the second external electrode 4 and the area at which the turn 11 faces the first external electrode 3 are smaller than the area at which turns 7, 8, 9, and 10 other than the turn 6 and the turn 11 face the first external electrode 3 or the second external electrode 4.

3 Claims, 7 Drawing Sheets

COIL COMPONENT

TECHNICAL FIELD

The present invention relates to a coil component.

BACKGROUND

The coil component that is described in Patent Literature 1 (Japanese Unexamined Patent Publication No. 2014-154716) is known as an example of coil components. The coil component described in Patent Literature 1 includes an element body including a pair of end surfaces facing each other, a pair of main surfaces facing each other, and a pair of side surfaces facing each other, a coil disposed in the element body, having a coil axis extending along the facing direction of the pair of side surfaces, and configured to include a plurality of turns, and a pair of external electrodes to which the coil is connected. In the coil, an end portion of the turn closest to one of the side surfaces in the facing direction of the pair of side surfaces is connected to one of the external electrodes and an end portion of the turn closest to the other side surface is connected to the other external electrode.

SUMMARY

In the coil component, the turn of the coil connected to one external electrode (the other external electrode) has a large potential difference at the part facing the other external electrode (one external electrode). Accordingly, electric field concentration occurs at the part of the turn facing the other external electrode (one external electrode). As a result, in the coil component, the parasitic capacitance (stray capacitance) generated between the turn of the coil and the external electrode increases, and thus the self-resonant frequency (SRF) decreases and the quality factor (Q) value also decreases in coil characteristics.

An object of one aspect of the present invention is to provide a coil component with which it is possible to improve the Q value while increasing the self-resonant frequency.

A coil component according to one aspect of the present invention includes an element body including a pair of end surfaces facing each other, a pair of main surfaces facing each other, and a pair of side surfaces facing each other, a coil disposed in the element body, having a coil axis extending along a facing direction of the pair of side surfaces, and including a plurality of turns, and a first external electrode to which one end of the coil is connected and a second external electrode to which the other end of the coil is connected. Each of the first external electrode and the second external electrode is disposed on at least one of the main surfaces and the first external electrode and the second external electrode are separated from each other in a facing direction of the pair of end surfaces, an end portion of a first outermost turn as the turn closest to one of the side surfaces in the facing direction of the pair of side surfaces is connected to the first external electrode and an end portion of a second outermost turn as the turn closest to the other side surface in the facing direction of the pair of side surfaces is connected to the second external electrode in the coil, and an area at which the first outermost turn faces the second external electrode and an area at which the second outermost turn faces the first external electrode are smaller than an area at which the turns other than the first outermost turn and the second outermost turn face the first external electrode or the second external electrode.

In the coil component according to one aspect of the present invention, the area at which the first outermost turn faces the second external electrode and the area at which the second outermost turn faces the first external electrode are smaller than the area at which the turns other than the first outermost turn and the second outermost turn face the first external electrode or the second external electrode. As a result, in the coil component, it is possible to reduce the parasitic capacitance that is generated between the first outermost turn and the second external electrode and between the second outermost turn and the first external electrode. As a result, in the coil component, it is possible to improve the Q value while increasing the self-resonant frequency.

In one embodiment, each of the first external electrode and the second external electrode may be disposed only on one of the main surfaces. In this configuration, the parasitic capacitance that is formed between the first outermost turn and the second external electrode and between the second outermost turn and the first external electrode can be reduced. Accordingly, in the coil component, it is possible to improve the Q value while increasing the self-resonant frequency.

In one embodiment, the first external electrode may include a first electrode part disposed on one of the end surfaces and a second electrode part disposed on one of the main surfaces and be disposed so as to straddle one of the end surfaces and one of the main surfaces, the second external electrode may include a third electrode part disposed on the other end surface and a fourth electrode part disposed on one of the main surfaces and be disposed so as to straddle the other end surface and one of the main surfaces, and an area at which the first outermost turn faces the first electrode part and an area at which the second outermost turn faces the third electrode part may be smaller than an area at which the turns other than the first outermost turn and the second outermost turn face the first electrode part or the third electrode part. In a case where the coil component is solder-fixed to a circuit board or the like in this configuration, solder is also formed at the first electrode part and the third electrode part positioned on the end surfaces of the element body, and thus the coil component can be firmly fixed to the circuit board or the like. In the coil component having this configuration, the stray capacitance that is formed between the first outermost turn and the first electrode part and between the second outermost turn and the third electrode part can be reduced. Accordingly, in the coil component, it is possible to improve the characteristics (self-resonant frequency and Q value) while ensuring mountability in relation to a circuit board or the like.

According to one aspect of the present invention, it is possible to improve the Q value while increasing the self-resonant frequency.

DETAILED DESCRIPTION

Figure 1:
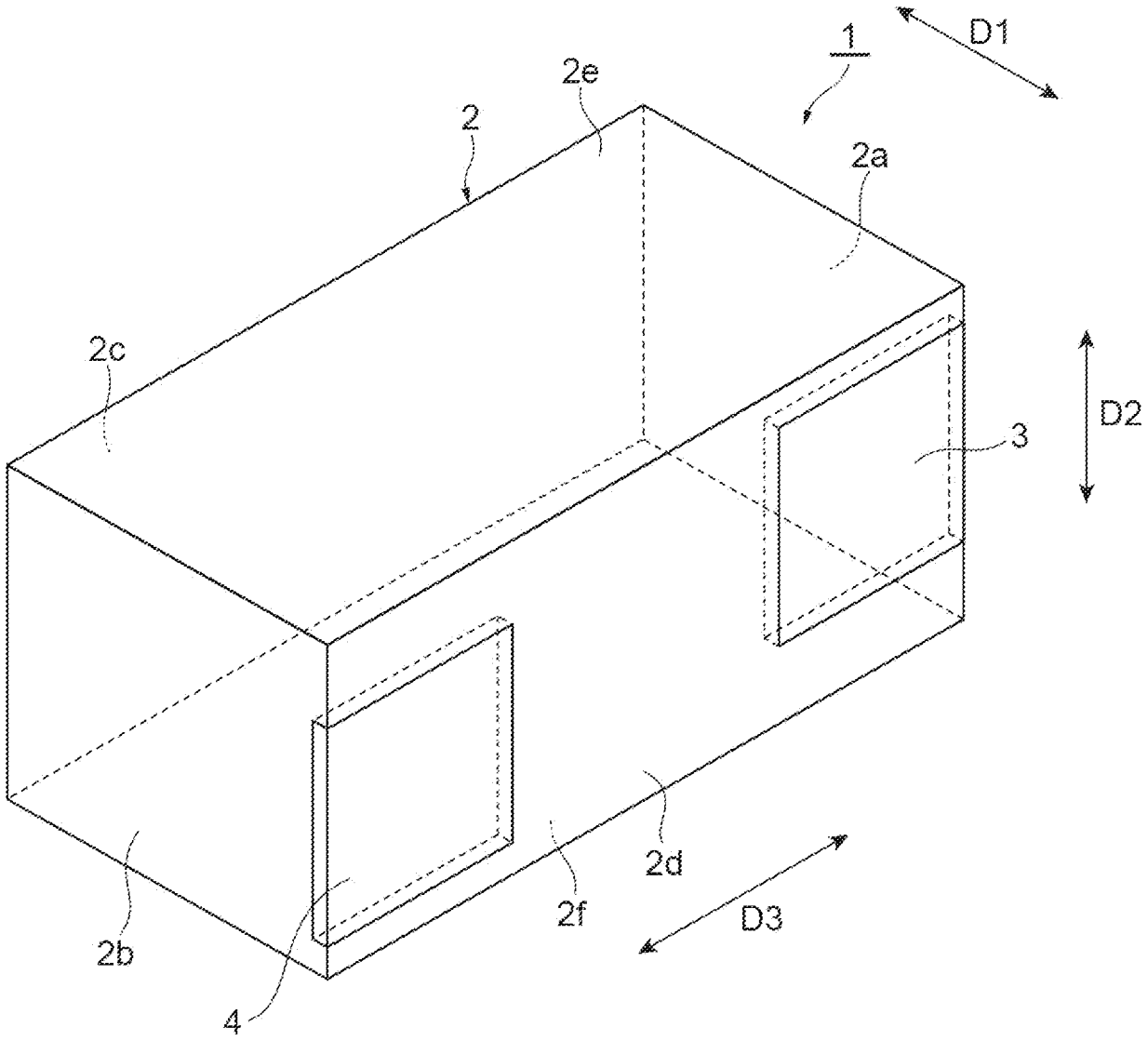
FIG. 1 is a perspective view illustrating a multilayer coil component according to an embodiment.

Hereinafter, preferred embodiments of the present invention will be described in detail with reference to the accompanying drawings. In the description of the drawings, the same or equivalent elements are denoted by the same reference numerals with redundant description omitted.

First Embodiment

As illustrated in FIG. 1, a multilayer coil component 1 includes an element body 2 having a rectangular parallelepiped shape, a first external electrode 3, and a second external electrode 4. The first external electrode 3 and the second external electrode 4 are disposed in both end portions of the element body 2, respectively. The rectangular parallelepiped shape includes a rectangular parallelepiped shape in which corner and ridgeline portions are chamfered and a rectangular parallelepiped shape in which corner and ridgeline portions are rounded.

The element body 2 has a pair of end surfaces 2*a* and 2*b* facing each other, a pair of main surfaces 2*c* and 2*d* facing each other, and a pair of side surfaces 2*e* and 2*f* facing each other. The facing direction of the pair of main surfaces 2*c* and 2*d*, that is, the direction parallel to the end surfaces 2*a* and 2*b* is a first direction D1. The facing direction of the pair of side surfaces 2*e* and 2*f* is a second direction D2. The facing direction of the pair of end surfaces 2*a* and 2*b*, that is, the direction parallel to the main surfaces 2*c* and 2*d* is a third direction D3. In the present embodiment, the first direction D1 is the height direction of the element body 2. The second direction D2 is the width direction of the element body 2 and is orthogonal to the first direction D1. The third direction D3 is the longitudinal direction of the element body 2 and is orthogonal to the first direction D1 and the second direction D2.

The pair of end surfaces 2*a* and 2*b* extend in the first direction D1 so as to interconnect the pair of main surfaces 2*c* and 2*d*. The pair of end surfaces 2*a* and 2*b* also extend in the second direction D2, that is, the short side direction of the pair of main surfaces 2*c* and 2*d*. The pair of side surfaces 2*e* and 2*f* extend in the first direction D1 so as to interconnect the pair of main surfaces 2*c* and 2*d*. The pair of side surfaces 2*e* and 2*f* also extend in the third direction D3, that is, the long side direction of the pair of end surfaces 2*a* and 2*b*. The multilayer coil component 1 is, for example, solder-mounted on an electronic device (such as a circuit board and an electronic component). In the multilayer coil component 1, the main surface (one main surface) 2*d* constitutes a mounting surface facing the electronic device.

The element body 2 is configured by stacking a plurality of dielectric layers in the second direction D2. The element body 2 has the plurality of stacked dielectric layers. In the element body 2, the direction in which the plurality of dielectric layers are stacked coincides with the second direction D2. In the actual element body 2, each dielectric layer is integrated to the extent that the boundary between the dielectric layers cannot be visually recognized. Each dielectric layer is formed of a dielectric material containing a glass component. In other words, the element body 2 contains a dielectric material containing a glass component as a compound of elements constituting the element body 2. The glass component is, for example, borosilicate glass. The dielectric material is, for example, dielectric ceramic such as $BaTiO_3$-based dielectric ceramic, $Ba(Ti,Zr)O_3$-based dielectric ceramic, and $(Ba,Ca)TiO_3$-based dielectric ceramic. Each dielectric layer is made of a sintered body of a ceramic green sheet containing a glass ceramic material. It should be noted that each dielectric layer may be made of a magnetic material. The magnetic material includes, for example, a Ni—Cu—Zn-based ferrite material, a Ni—Cu—Zn—Mg-based ferrite material, or a Ni—Cu-based ferrite material. The magnetic material constituting each dielectric layer may contain an Fe alloy. Each dielectric layer may be made of a nonmagnetic material. The nonmagnetic material includes, for example, a glass ceramic material or a dielectric material.

As illustrated in FIG. 1, each of the first external electrode 3 and the second external electrode 4 is disposed on the main surface 2*d* of the element body 2. Each of the first external electrode 3 and the second external electrode 4 is embedded in the element body 2. The first external electrode 3 and the second external electrode 4 are separated from each other in the third direction D3. The first external electrode 3 is disposed on the end surface 2*a* side. The second external electrode 4 is disposed on the end surface 2*b* side. Each of the first external electrode 3 and the second external electrode 4 has a rectangular shape when viewed from the first direction D1. The first external electrode 3 and the second external electrode 4 extend along the second direction D2 and the third direction D3. The first external electrode 3 and the second external electrode 4 are formed to have the same size.

The first external electrode 3 and the second external electrode 4 are disposed so as to be misaligned with each other in the second direction D2 when viewed from the first direction D1. Specifically, the first external electrode 3 is disposed close to the side surface 2*e* when viewed from the second direction D2 and the second external electrode 4 is disposed close to the side surface 2*f* when viewed from the second direction D2. In the present embodiment, the surface of the first external electrode 3 is substantially flush with the main surface 2*d*. The surface of the second external electrode 4 is substantially flush with the main surface 2*d*.

The first external electrode 3 and the second external electrode 4 contain a conductive material. The conductive material contains, for example, Ag or Pd. The first external electrode 3 and the second external electrode 4 are configured as a sintered body of conductive paste containing conductive material powder. The conductive material powder includes, for example, Ag powder or Pd powder. A plating layer may be formed on the surfaces of the first external electrode 3 and the second external electrode 4. The plating layer is formed by, for example, electroplating or electroless plating. The plating layer contains, for example, Ni, Sn, or Au.

Each of the first external electrode 3 and the second external electrode 4 is configured by stacking a plurality of electrode layers (not illustrated). The electrode layer has a rectangular shape when viewed from the second direction D2. Each electrode layer is provided in a defect portion formed in the corresponding dielectric layer. The electrode layer is formed by firing conductive paste positioned in a defect portion formed on a green sheet. The green sheet and the conductive paste are fired at the same time. Accordingly, the electrode layer is obtained from the conductive paste when the dielectric layer is obtained from the green sheet. In the actual first external electrode, each electrode layer is integrated to the extent that the boundary between the electrode layers cannot be visually recognized.

Figure 2:
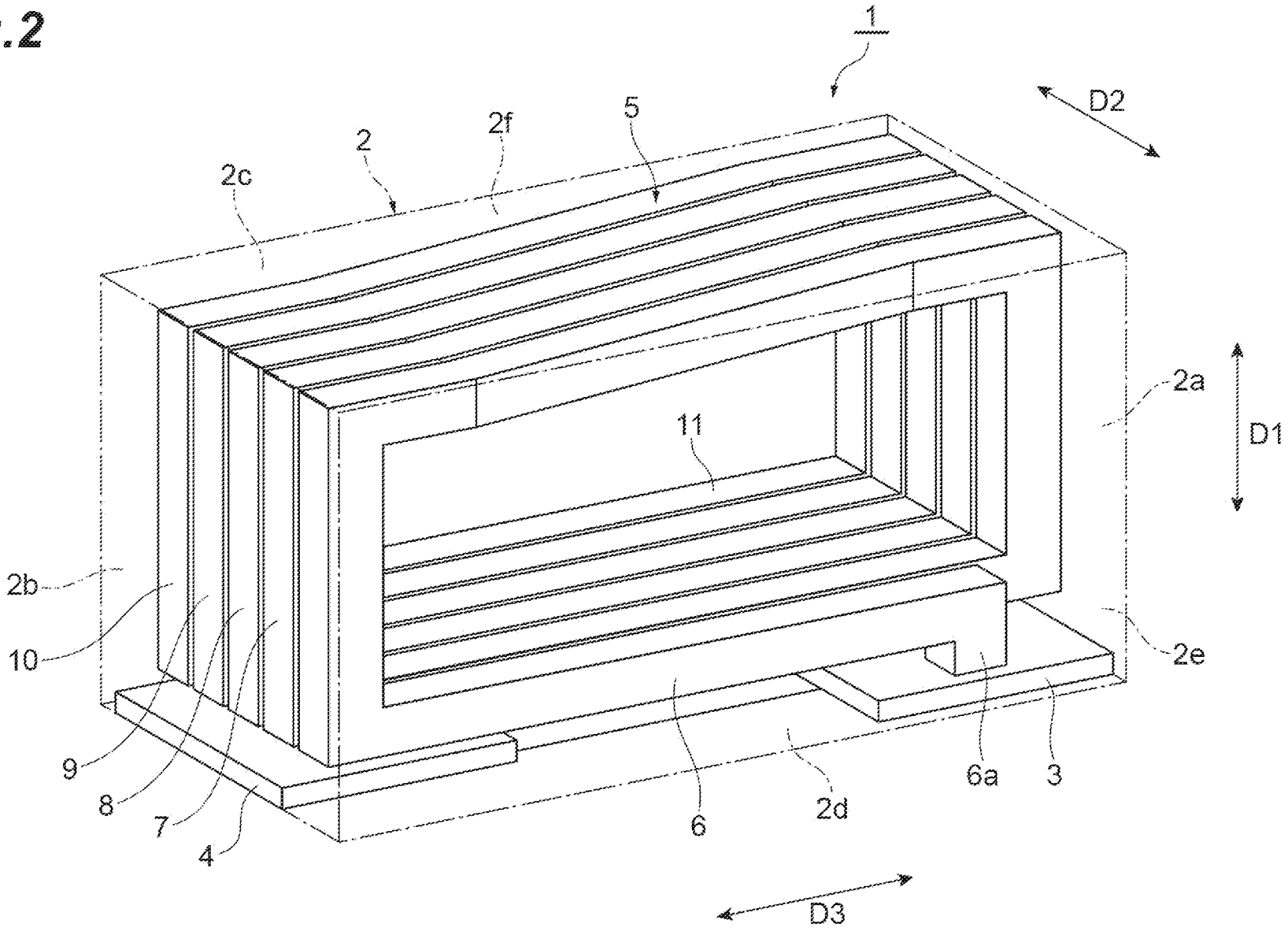
FIG. 2 is a perspective view illustrating the internal configuration of the multilayer coil component illustrated in FIG. 1.
Figure 3:
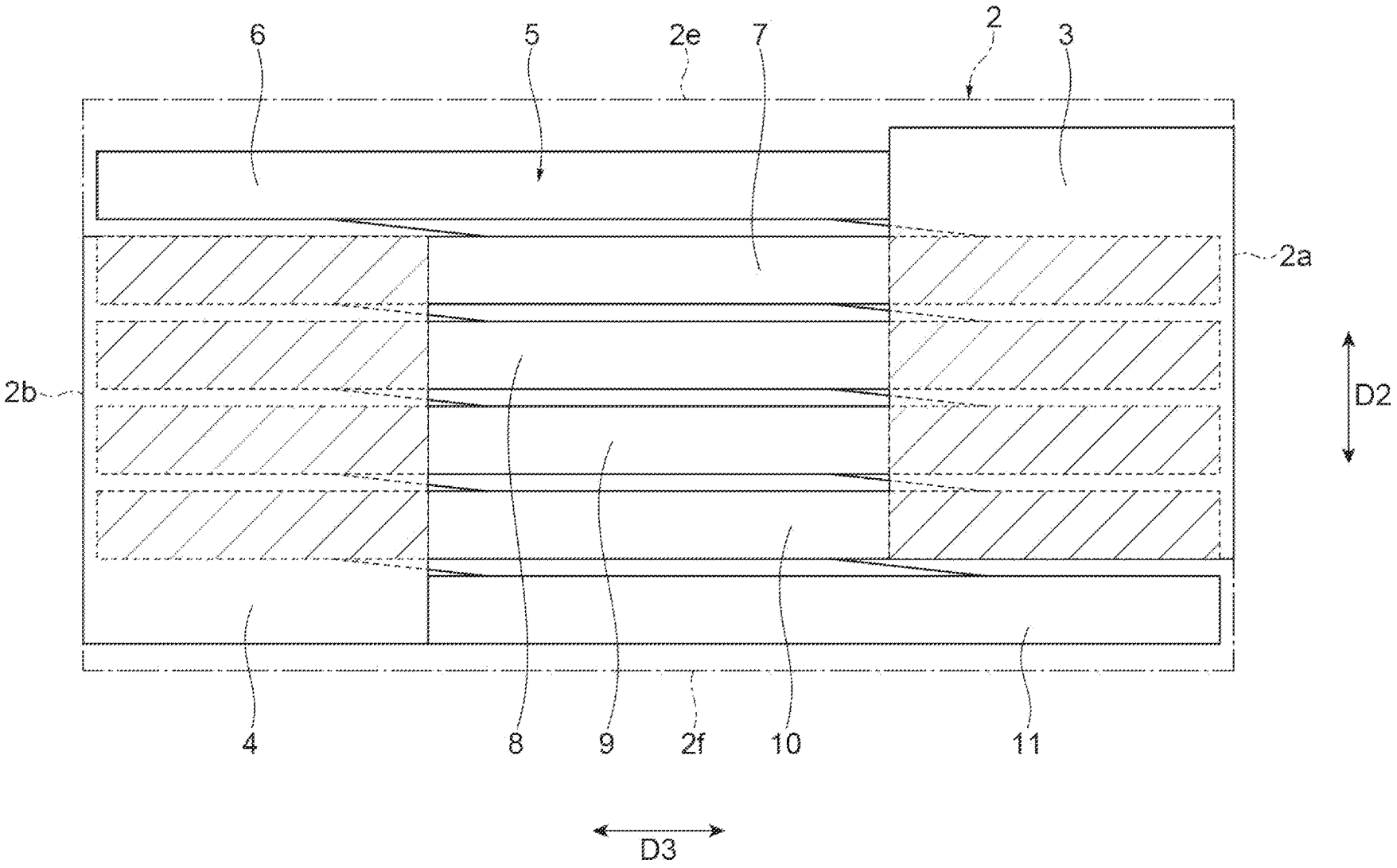
FIG. 3 is a side view illustrating the internal configuration of the multilayer coil component illustrated in FIG. 1.

The multilayer coil component 1 includes a coil 5 disposed in the element body 2 as illustrated in FIGS. 2 and 3. The coil axis of the coil 5 extends along the second direction D2. One end of the coil 5 is connected to the first external electrode 3, and the other end of the coil 5 is connected to the second external electrode 4. The coil 5 is configured to include a plurality of turns 6, 7, 8, 9, 10, and 11. Each of the turns 6, 7, 8, 9, 10, and 11 is formed by a coil conductor (coil portion).

In the coil 5, the turn 6, the turn 7, the turn 8, the turn 9, the turn 10, and the turn 11 are disposed in this order between the side surface 2*e* and the side surface 2*f*. The turn 7, the turn 8, the turn 9, and the turn 10 are disposed between the turn 6 and the turn 11. The turn 6, the turn 7, the turn 8, the turn 9, the turn 10, and the turn 11 have a constant width. In other words, the turn 6, the turn 7, the turn 8, the turn 9, the turn 10, and the turn 11 are formed to have the same width.

The turn 6 is the first outermost turn that is closest to the side surface 2*e* (one side surface) in the second direction D2. An end portion 6*a* of the turn 6 is connected to the first external electrode 3. As a result, the coil 5 is connected to the first external electrode 3. The turn 7 is connected to the turn 6. The turn 8 is connected to the turn 7. The turn 9 is connected to the turn 8. The turn 10 is connected to the turn 9. The turn 11 is the second outermost turn that is closest to the side surface 2*f* (the other side surface) in the second direction D2. An end portion 11*a* of the turn 11 is connected to the second external electrode 4. As a result, the coil 5 is connected to the second external electrode 4.

In the multilayer coil component 1, the area at which the turn 6 faces the second external electrode 4 and the area at which the turn 11 faces the first external electrode 3 are smaller than the area at which the turns 7, 8, 9, and 10 other than the turn 6 and the turn 11 face the first external electrode 3 or the second external electrode 4. As illustrated in FIG. 3, the second external electrode 4 is not disposed at a position facing the turn 6. In other words, the turn 6 does not face the second external electrode 4. The facing area between the turn 6 and the second external electrode 4 is "0". The turns 7, 8, 9, and 10 face the second external electrode 4 (diagonal parts in FIG. 4). Accordingly, the area at which the turn 6 faces the second external electrode 4 is smaller than the area at which the turns 7, 8, 9, and 10 face the second external electrode 4.

The first external electrode 3 is not disposed at a position facing the turn 11. In other words, the turn 11 does not face the first external electrode 3. The facing area between the turn 11 and the first external electrode 3 is "0". The turns 7, 8, 9, and 10 face the first external electrode 3 (diagonal parts in FIG. 4). Accordingly, the area at which the turn 11 faces the first external electrode 3 is smaller than the area at which the turns 7, 8, 9, and 10 face the first external electrode 3.

The plurality of turns 6, 7, 8, 9, 10, and 11 contain a conductive material. The conductive material contains Ag or Pd. The plurality of turns 6, 7, 8, 9, 10, and 11 are configured as a sintered body of conductive paste containing conductive material powder. The conductive material powder includes, for example, Ag powder or Pd powder. In the present embodiment, the plurality of turns 6, 7, 8, 9, 10, and 11 contain the same conductive material as the first external electrode 3 and the second external electrode 4. The plurality of turns 6, 7, 8, 9, 10, and 11 may contain a conductive material different from the conductive material of the first external electrode 3 and the second external electrode 4.

The plurality of turns 6, 7, 8, 9, 10, and 11 are provided in defect portions formed in the corresponding dielectric layers. The plurality of turns 6, 7, 8, 9, 10, and 11 are formed by firing conductive paste positioned in a defect portion formed on a green sheet. As described above, the green sheet and the conductive paste are fired at the same time. Accordingly, the plurality of turns 6, 7, 8, 9, 10, and 11 are obtained from the conductive paste when the dielectric layers are obtained from the green sheet.

The defect portion formed on the green sheet is formed by, for example, the following process. First, the green sheet is formed by applying element body paste containing a constituent material of a dielectric layer and a photosensitive material onto a base material. The base material is, for example, a PET film. The photosensitive material contained in the element body paste may be either a negative-type photosensitive material or a positive-type photosensitive material and known photosensitive materials can be used. Next, the green sheet is exposed and developed by a photolithography method and by means of a mask corresponding to the defect portion, and then the defect portion is formed on the green sheet on the base material. The green sheet on which the defect portion is formed is an element body pattern.

The plurality of turns 6, 7, 8, 9, 10, and 11 are formed by, for example, the following process. First, a conductor material layer is formed by applying conductive paste containing a photosensitive material onto a base material. The photosensitive material contained in the conductive paste may be either a negative-type photosensitive material or a positive-type photosensitive material and known photosensitive materials can be used. Next, the conductor material layer is exposed and developed by a photolithography method and by means of a mask corresponding to the defect portion, and then a conductor pattern corresponding to the shape of the defect portion is formed on the base material.

The multilayer coil component 1 is obtained by, for example, the following process following the process described above. A sheet in which the element body pattern and the conductor pattern are in the same layer is prepared by combining the conductor pattern with the defect portion of the element body pattern. A predetermined number of the sheets are prepared, a stacked body is obtained by stacking the sheets, and the stacked body is heat-treated. Then, a plurality of green chips are obtained from the stacked body. In this process, the green stacked body is cut into chips by means of, for example, a cutting machine. As a result, the plurality of green chips having a predetermined size can be obtained. Next, the green chips are fired. The multilayer coil component 1 is obtained as a result of the firing. In the multilayer coil component 1, the first external electrode 3, the second external electrode 4, and the coil 5 are integrally formed.

As described above, in the multilayer coil component 1 according to the present embodiment, the area at which the turn 6 faces the second external electrode 4 and the area at which the turn 11 faces the first external electrode 3 are smaller than the area at which the turns 7, 8, 9, and 10 other than the turn 6 and the turn 11 face the first external electrode 3 or the second external electrode 4. In the multilayer coil component 1 according to the present embodiment, the turn 6 and the second external electrode 4 and the turn 11 and the first external electrode 3 are not disposed so as to face each other. As a result, in the multilayer coil component 1, it is possible to reduce the parasitic capacitance that is generated (prevent parasitic capacitance from being generated) between the turn 6 and the second external electrode 4 and between the turn 11 and the first external electrode 3. As a result, in the multilayer coil component 1, it is possible to improve the Q value while increasing the self-resonant frequency.

Figure 4:
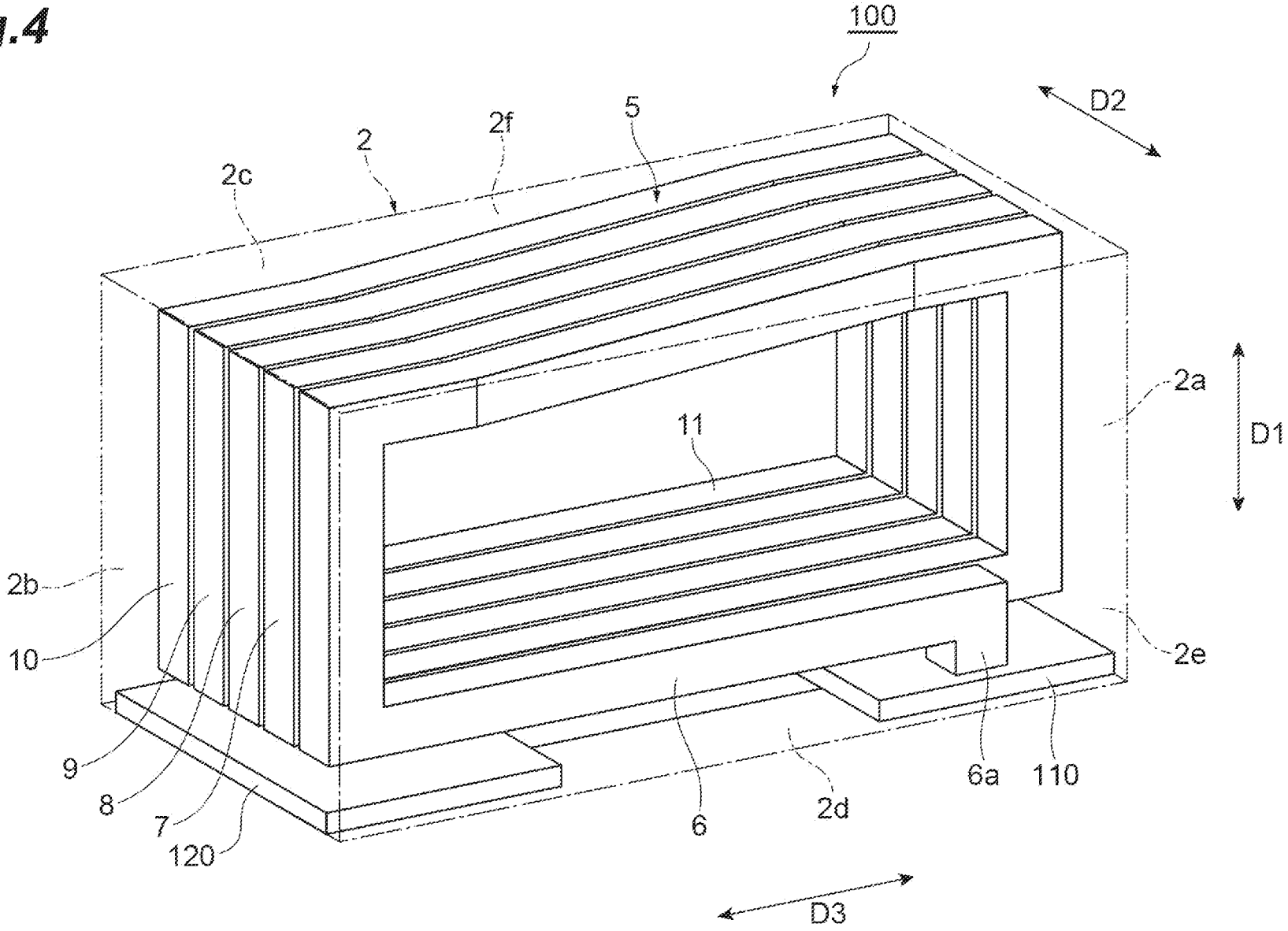
FIG. 4 is a perspective view illustrating the internal configuration of a multilayer coil component according to a comparative example.

In a multilayer coil component 100 illustrated in FIG. 4, every turn 6, 7, 8, 9, 10, and 11 of the coil 5 is disposed so as to face a first external electrode 110 or a second external electrode 120. In other words, in the multilayer coil component 100, the facing area between the turn 6 and the second external electrode 120 is equal to the facing area between the turns 7, 8, 9, and 10 and the second external electrode 120. In the multilayer coil component 100, the facing area between the turn 11 and the first external electrode 110 is equal to the facing area between the turns 7, 8, 9, and 10 and the first external electrode 110.

Figure 5:
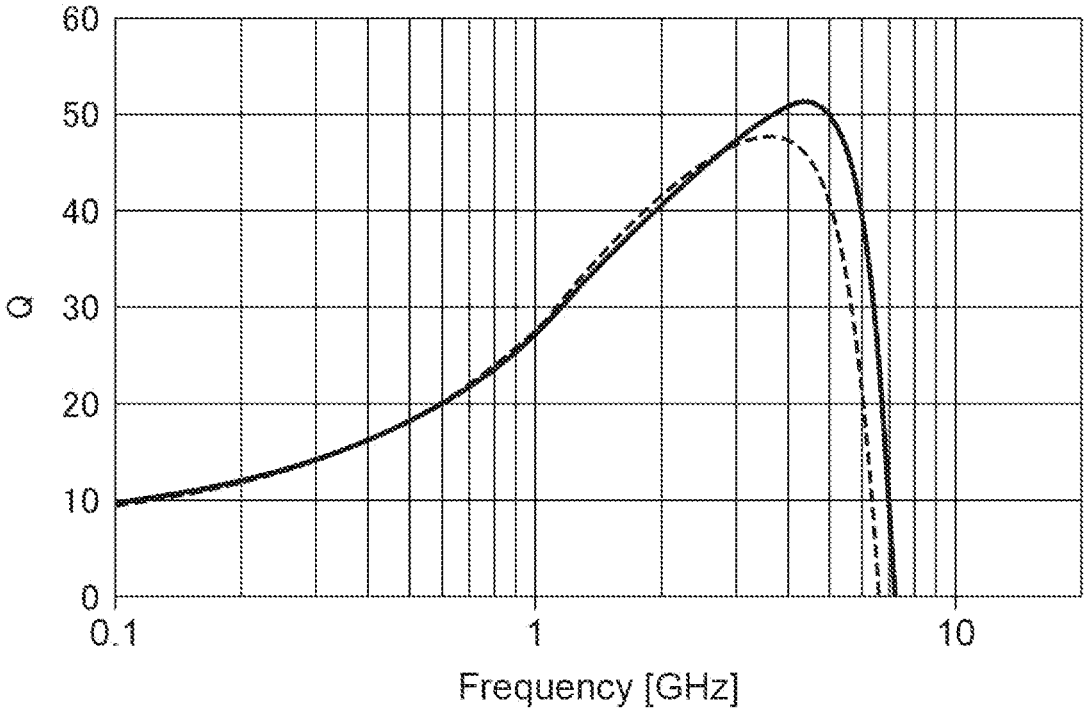
FIG. 5 is a graph showing a frequency-Q value relationship.

In FIG. 5, the horizontal axis is the frequency [GHz] and the vertical axis is the Q value. In FIG. 5, the characteristics of the multilayer coil component 1 are indicated by a solid line and the characteristics of the multilayer coil component 100 are indicated by a dashed line. As illustrated in FIG. 5, the Q value in the high frequency band is higher in the multilayer coil component 1 than in the multilayer coil component 100. Accordingly, in the multilayer coil component 1, it is possible to improve the Q value while increasing the self-resonant frequency.

In the multilayer coil component 1 according to the present embodiment, each of the first external electrode 3 and the second external electrode 4 is disposed only on the main surface 2*d* of the element body 2. In this configuration, the parasitic capacitance that is formed between the turn 6 and the second external electrode 4 and between the turn 11 and the first external electrode 3 can be reduced. Accordingly, in the multilayer coil component 1, it is possible to improve the Q value while increasing the self-resonant frequency.

Second Embodiment

Figure 6:
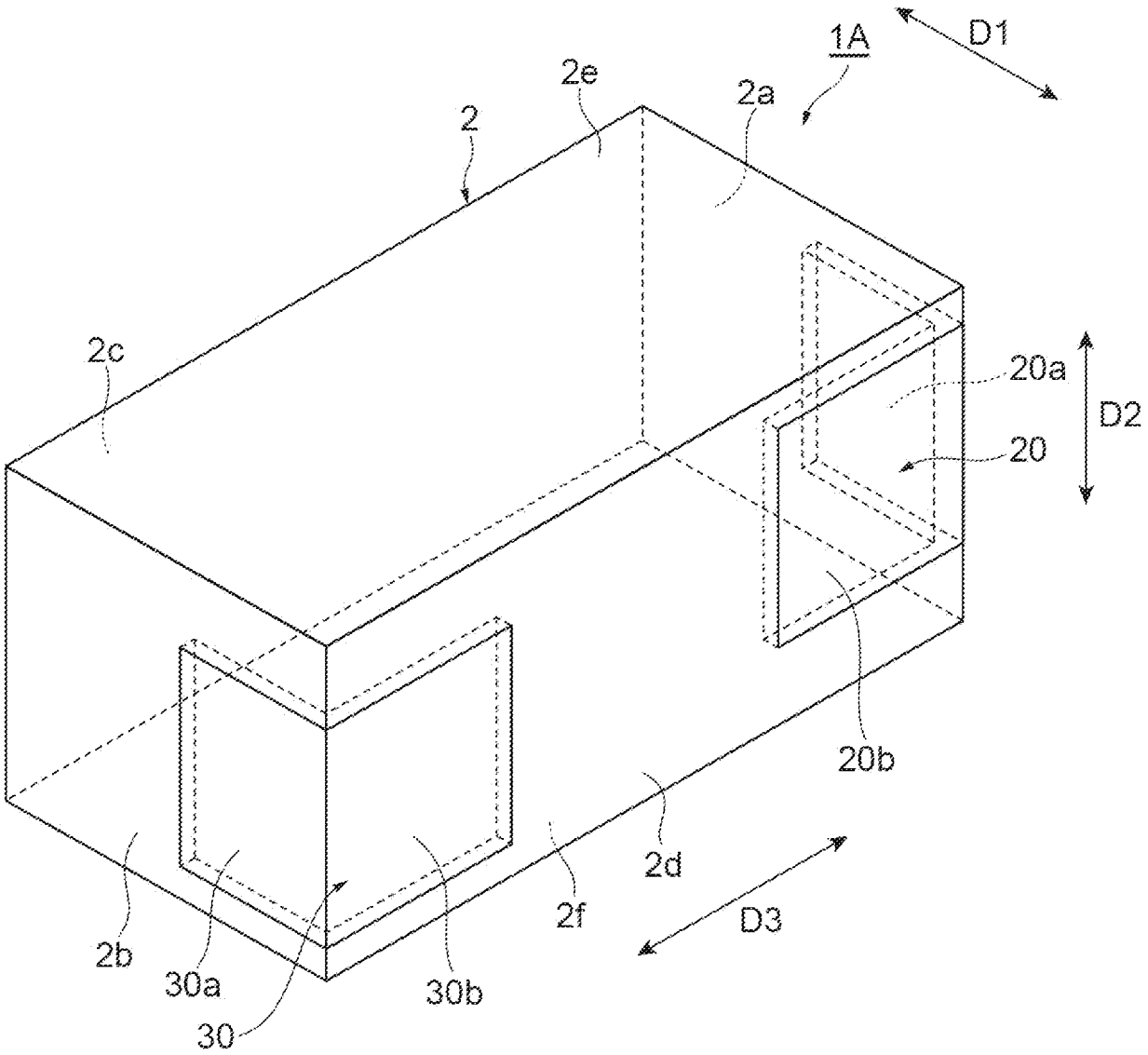
FIG. 6 is a perspective view illustrating the internal configuration of a multilayer coil component according to a second embodiment.

A second embodiment will be described below. As illustrated in FIG. 6, a multilayer coil component 1A includes a first external electrode 20 and a second external electrode 30.

The first external electrode 20 is disposed on the end surface 2*a* side of the element body 2. The second external electrode 30 is disposed on the end surface 2*b* side of the element body 2. The first external electrode 20 and the second external electrode 30 are separated from each other in the third direction D3.

The first external electrode 20 is disposed over the end surface 2*a* and the main surface 2*d*. The first external electrode 20 has an L shape when viewed from the second direction D2. The first external electrode 20 has a plurality of electrode parts 20*a* and 20*b*. In the present embodiment, the first external electrode 20 has a pair of electrode parts 20*a* and 20*b*. The electrode part (first electrode part) 20*a* and the electrode part (second electrode part) 20*b* are connected in the ridgeline portion of the element body 2 and are electrically connected to each other. In the present embodiment, the electrode part 20*a* and the electrode part 20*b* are integrally formed. The electrode part 20*a* extends along the first direction D1. The electrode part 20*a* has a rectangular shape when viewed from the third direction D3. The electrode part 20*b* extends along the third direction D3. The electrode part 20*b* has a rectangular shape when viewed from the first direction D1. The electrode parts 20*a* and 20*b* extend along the second direction D2. The surface of the first external electrode 20 is substantially flush with each of the end surface 2*a* and the main surface 2*d*.

The second external electrode 30 is disposed over the end surface 2*b* and the main surface 2*d*. The second external electrode 30 has an L shape when viewed from the second direction D2. The second external electrode 4 has a plurality of electrode parts 30*a* and 30*b*. In the present embodiment, the second external electrode 30 has a pair of electrode parts 30*a* and 30*b*. The electrode part (third electrode part) 30*a* and the electrode part (fourth electrode part) 30*b* are connected in the ridgeline portion of the element body 2 and are electrically connected to each other. In the present embodiment, the electrode part 30*a* and the electrode part 30*b* are integrally formed. The electrode part 30*a* extends along the first direction D1. The electrode part 30*a* has a rectangular shape when viewed from the third direction D3. The electrode part 30*b* extends along the third direction D3. The electrode part 30*b* has a rectangular shape when viewed from the first direction D1. The electrode parts 30*a* and 30*b* extend along the second direction D2. The surface of the second external electrode 30 is substantially flush with each of the end surface 2*b* and the main surface 2*d*.

The first external electrode 20 and the second external electrode 30 are disposed so as to be misaligned with each other in the second direction D2 when viewed from the first direction D1. Specifically, the first external electrode 20 is disposed close to the side surface 2*e* when viewed from the second direction D2 and the second external electrode 30 is disposed close to the side surface 2*f* when viewed from the second direction D2.

Figure 7:
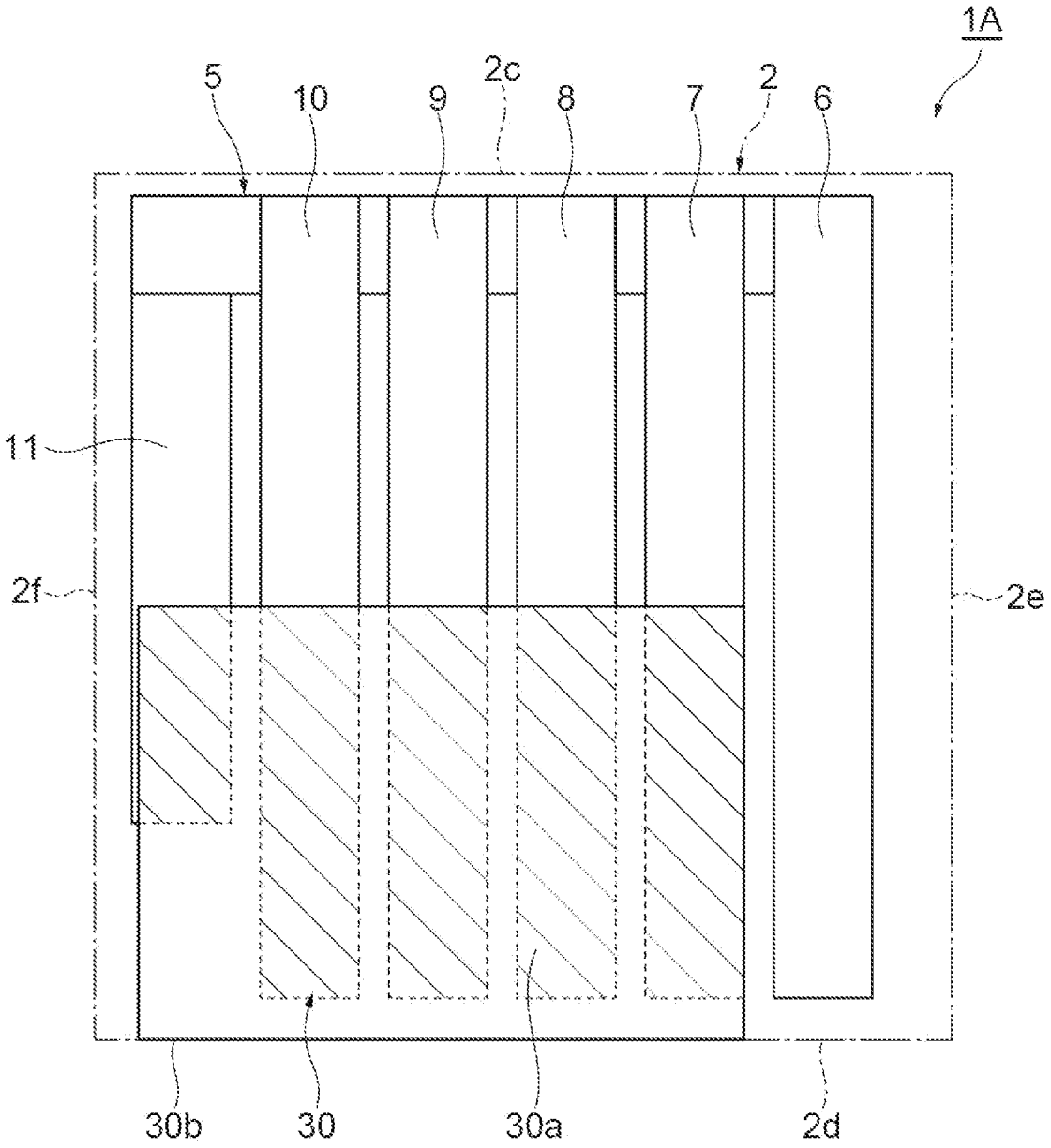
FIG. 7 is a side view illustrating the internal configuration of the multilayer coil component illustrated in FIG. 6.

In the multilayer coil component 1A, the area at which the turn 6 faces the second external electrode 30 and the area at which the turn 11 faces the first external electrode 20 are smaller than the area at which the turns 7, 8, 9, and 10 other than the turn 6 and the turn 11 face the first external electrode 20 or the second external electrode 30. The second external electrode 30 is not disposed at a position facing the turn 6. As illustrated in FIG. 7, the turn 6 does not face the electrode part 30*a* and the electrode part 30*b* of the second external electrode 30. The facing area between the turn 6 and the second external electrode 30 is "0". The turns 7, 8, 9, and 10 face the second external electrode 30 (diagonal parts in FIG. 7). Accordingly, the area at which the turn 6 faces the second external electrode 30 is smaller than the area at which the turns 7, 8, 9, and 10 face the second external electrode 30.

The first external electrode 20 is not disposed at a position facing the turn 11. The turn 11 does not face the electrode part 20*a* and the electrode part 20*b* of the first external electrode 20. The facing area between the turn 11 and the first external electrode 20 is "0". The turns 7, 8, 9, and 10 face the first external electrode 20. Accordingly, the area at which the turn 11 faces the first external electrode 20 is smaller than the area at which the turns 7, 8, 9, and 10 face the first external electrode 20.

As described above, in the multilayer coil component 1A according to the present embodiment, the area at which the turn 6 faces the second external electrode 30 and the area at which the turn 11 faces the first external electrode 20 are smaller than the area at which the turns 7, 8, 9, and 10 other than the turn 6 and the turn 11 face the first external electrode 20 or the second external electrode 30. In the multilayer coil component 1A according to the present embodiment, the turn 6 and the second external electrode 30 and the turn 11 and the first external electrode 20 are not disposed so as to face each other. As a result, in the multilayer coil component 1A, it is possible to reduce the parasitic capacitance that is generated (prevent parasitic capacitance from being generated) between the turn 6 and the second external electrode 30 and between the turn 11 and the first external electrode 20. As a result, in the multilayer coil component 1A, it is possible to improve the Q value while increasing the self-resonant frequency.

In the multilayer coil component 1A according to the present embodiment, the first external electrode 20 includes the electrode part 20*a* disposed on one end surface 2*a* and the electrode part 20*b* disposed on one main surface 2*d* and is disposed so as to straddle one end surface 2*a* and one main surface 2*d*. The second external electrode 30 includes the electrode part 30*a* disposed on the other end surface 2*a* and the electrode part 30*b* disposed on one main surface 2*d* and is disposed so as to straddle the other end surface 2*b* and one main surface 2*d*. The area at which the turn 6 faces the electrode part 20*a* and the area at which the turn 11 faces the electrode part 30*a* are smaller than the area at which the turn 10 other than the turn 6 and the turn 11 faces the electrode part 20*a* or the electrode part 30*a*. In a case where the multilayer coil component 1 is solder-fixed to a circuit board or the like in this configuration, solder is also formed at the electrode part 20*a* of the first external electrode 20 and the electrode part 30*a* of the second external electrode 30 positioned on the end surfaces 2*a* and 2*b* of the element body 2, and thus the multilayer coil component 1A can be firmly fixed to the circuit board or the like. In the multilayer coil component 1 having this configuration, the stray capacitance that is formed between the turn 6 and the electrode part 20*a* and between the turn 11 and the electrode part 30*a* can be reduced. Accordingly, in the multilayer coil component 1A, it is possible to improve the characteristics (self-resonant frequency and Q value) while ensuring mountability in relation to a circuit board or the like.

Although embodiments of the present invention have been described above, the present invention is not necessarily limited to the above-described embodiments and various modifications can be made without departing from the gist of the present invention.

In the above embodiment, a form in which the turn 6 does not face the second external electrode 4 has been described as an example. Alternatively, the turn 6 may be configured to face the second external electrode 4. In this case, the area at which the turn 6 faces the second external electrode 4 may be smaller than the area at which the turns 7, 8, 9, and 10 other than the turn 6 face the second external electrode 4. The same applies to the turn 11.

In the above embodiment, a form in which the turn 6 does not face the electrode part 30*a* and the electrode part 30*b* of the second external electrode 30 has been described as an example. Alternatively, the turn 6 may be configured not to face the electrode part 30*a* or the electrode part 30*b* of the second external electrode 30. The same applies to the turn 11.

In the above embodiment, a form in which each of the first external electrode 3 and the second external electrode 4 is embedded in the element body 2 has been described as an example. Alternatively, each of the first external electrode 3 and the second external electrode 4 may be disposed on the main surface 2*d* of the element body 2. The same applies to the first external electrode 20 and the second external electrode 30.

In the above embodiment, a configuration in which the coil 5 includes the turns 6, 7, 8, 9, 10, and 11 has been described as an example. However, the number of turns constituting the coil is not limited thereto.

In the above embodiment, a form in which the turns 6, 7, 8, 9, 10, and 11 of the coil 5 have a rectangular outer shape as illustrated in FIGS. 2 and 3 has been described as an example. However, the shape of the turns of the coil is not limited thereto.

What is claimed is:

1. A coil component comprising:

an element body including a pair of end surfaces facing each other, a pair of main surfaces facing each other, and a pair of side surfaces facing each other;

a coil disposed in the element body, having a coil axis extending along a facing direction of the pair of side surfaces, the coil including:

a first outermost turn closest to one of the side surfaces in the facing direction of the pair of side surfaces;

a second outermost turn closest to the other side surface in the facing direction of the pair of side surfaces; and a plurality of inner turns between the first outermost turn and the second outermost turn;

a first external electrode to which an end portion of the first outermost turn is connected; and a second external electrode to which an end portion of the second outermost turn is connected, wherein each of the first external electrode and the second external electrode is disposed on at least one of the main surfaces and the first external electrode and the second external electrode are separated from each other in a facing direction of the pair of end surfaces, and in a facing direction of the pair of main surfaces, each of the plurality of inner turns overlaps the second electrode more than the first outermost turn overlaps the second electrode, and each of the plurality of inner turns overlaps the first electrode more than the second outermost turn overlaps the first electrode.

2. The coil component according to claim 1, wherein each of the first external electrode and the second external electrode is disposed only on one of the main surfaces.

3. The coil component according to claim 1, wherein the first external electrode includes a first electrode part disposed on one of the end surfaces and a second electrode part disposed on one of the main surfaces and is disposed so as to straddle one of the end surfaces and one of the main surfaces, the second external electrode includes a third electrode part disposed on the other end surface and a fourth electrode part disposed on one of the main surfaces and is disposed so as to straddle the other end surface and one of the main surfaces, and in the facing direction of the pair of end surfaces, each of the plurality of inner turns overlaps the first electrode part more than the first outermost turn overlaps the first electrode part, and each of the plurality of inner turns overlaps the third electrode part more than the second outermost turn overlaps the third electrode part.

* * * * *